United States Patent [19]

Mickelson et al.

[11] Patent Number: 4,594,815

[45] Date of Patent: Jun. 17, 1986

[54] ABRASIVE SURFACER

[75] Inventors: Maurice G. Mickelson; Herman J. Mutzberg, both of Minneapolis, Minn.

[73] Assignee: Timesavers, Inc., Minneapolis, Minn.

[21] Appl. No.: 679,285

[22] Filed: Dec. 7, 1984

Related U.S. Application Data

[63] Continuation of Ser. No. 509,793, Jul. 1, 1983, abandoned, which is a continuation of Ser. No. 258,613, Apr. 29, 1981, abandoned.

[51] Int. Cl.[4] ..... B24B 21/04

[52] U.S. Cl. ..... 51/138; 51/80 A; 51/139; 51/140; 51/215 E; 51/273; 144/246 A; 144/247

[58] Field of Search ..... 51/76 R, 78, 80 A, 87 R, 51/112, 135 R, 137, 138, 139, 140, 215 R, 215 E, 215.5 F, 268, 270, 273, 328; 144/2 R, 247, 250, 252 R, 246 A, 246 F, 247; 198/836; 152/302, 303, 323; 193/37; 16/45; 29/130, 132

[56] References Cited

U.S. PATENT DOCUMENTS

| | | | |
|---|---|---|---|
| 985,366 | 2/1911 | Orton | 144/250 R |
| 1,619,009 | 3/1927 | Wilderson | 144/250 R |
| 2,671,992 | 3/1954 | Reaser et al. | 51/80 A |
| 2,761,547 | 9/1956 | Gehrer | 193/37 X |
| 3,152,387 | 10/1964 | Macleod | 29/130 |
| 3,166,874 | 1/1965 | Bottcher | 51/87 R |
| 3,178,860 | 4/1965 | Clyne | 51/140 X |
| 3,269,065 | 8/1966 | Nylund | 51/140 X |
| 3,394,501 | 7/1968 | Carlson et al. | 51/138 |
| 3,514,829 | 6/1970 | Blatt | 29/130 |
| 3,872,627 | 3/1975 | Schuster | 51/138 X |
| 3,895,464 | 7/1975 | Kiser | 51/80 A X |
| 4,151,705 | 5/1979 | Evans | 51/139 |
| 4,178,721 | 12/1979 | Evans | 51/140 |
| 4,258,506 | 3/1981 | Robinson | 51/138 X |
| 4,322,919 | 4/1982 | Gerber | 51/139 |
| 4,441,536 | 4/1984 | Rautio | 144/246 A X |

FOREIGN PATENT DOCUMENTS

| | | | |
|---|---|---|---|
| 190266 | 6/1957 | Austria | 144/246 A |

*Primary Examiner*—Robert P. Olszewski

*Attorney, Agent, or Firm*—Orrin M. Haugen; Thomas J. Nikolai; Frederick W. Niebuhr

[57] ABSTRACT

A machine for simultaneously surfacing the opposite faces of workpieces with abrasive belts wider than the workpieces, which includes mechanism for feeding workpieces of different thicknesses simultaneously, and centering mechanism for engaging the surfaces of the workpieces as they pass through the machine.

8 Claims, 16 Drawing Figures

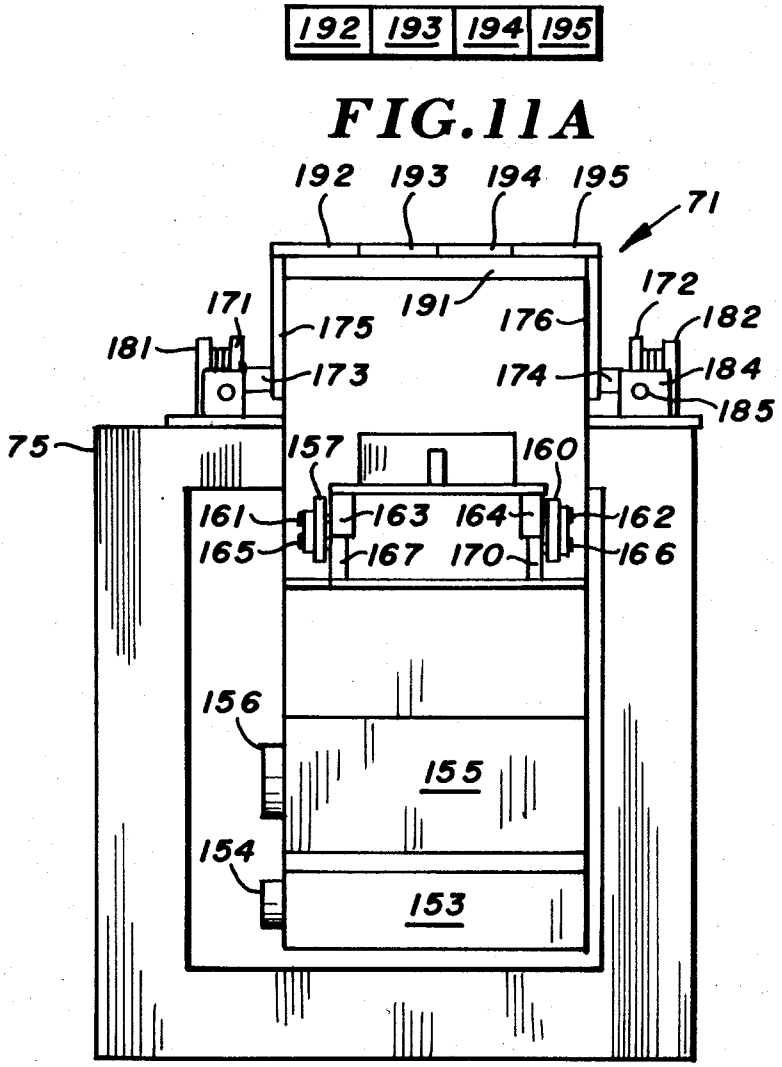
FIG. 11A
FIG. 11
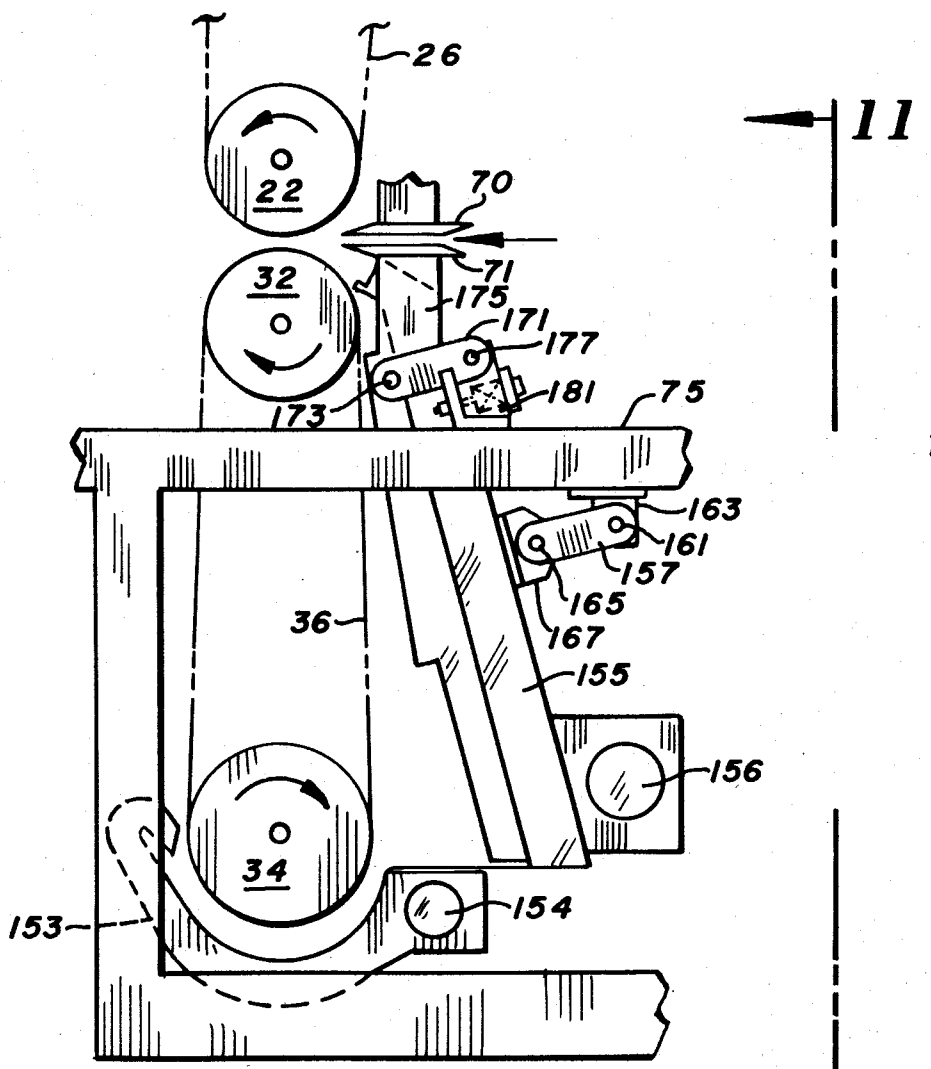
FIG. 10

ABRASIVE SURFACER

CROSS-REFERENCE TO RELATED APPLICATIONS

This application is a continuation of application Ser. No. 509,793, filed July 1, 1983, now abandoned, which in turn was a continuation of application Ser. No. 258,613, filed Apr. 29, 1981, now abandoned.

TECHNICAL FIELD

This invention relates to the field of woodworking, and particularly to machines for surfacing both faces of wooden workpieces on a single pass through the machine.

BACKGROUND OF THE INVENTION

The use of abrasive belts in machines for surfacing lumber is well-known, being taught for example in Schuster U.S. Pat. No. 3,872,627. When surfacing lumber of less width than the abrasive belts themselves, efficiency is served if several workpieces can pass through the machine in side-by-side relationship, both faces of each piece being surfaced at the same time and with removal of substantially the same thickness from each surface of the work, thereby finishing all workpieces to the same ultimate thickness. This results in some difficulty, however because as supplied from the sawmill, unfinished lumber workpieces not only vary considerably in thickness, but are frequently bowed or curved transversely, either of which can interfere with proper feed of the pieces through the machine. The device of the present invention permits the unfinished lumber workpieces to be treated on opposed surfaces with both such surfaces receiving cuts of substantially the same thickness.

SUMMARY OF THE INVENTION

The present invention comprises an abrasive surfacer having upper and lower abrasive heads on which wide abrasive belts are trained, and means for feeding workpieces between the heads to be surfaced simultaneously and at substantially equal depths on both faces, including means feeding workpieces narrower than the belts and of somewhat different thicknesses in such a manner that the pieces are centered between the heads and are gripped firmly and efficiently, yet softly for feeding without hesitation, chatter, or damage to the lumber being surfaced.

Various advantages and features of novelty which characterize the invention are pointed out with particularity in the claims annexed hereto and forming a part hereof. However, for a better understanding of the invention, its advantages, and objects obtained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawings, in which like reference numerals indicate corresponding parts throughout the several views.

FIG. 10 is a fragmentary rear view in elevation showing a lower dust collector and centering mechanism;

FIG. 11 is a side view of the structure of FIG. 10;

FIG. 11A is a fragmentary view of a portion of FIG. 11;

DESCRIPTION OF THE PREFERRED EMBODIMENT

Figure 1:
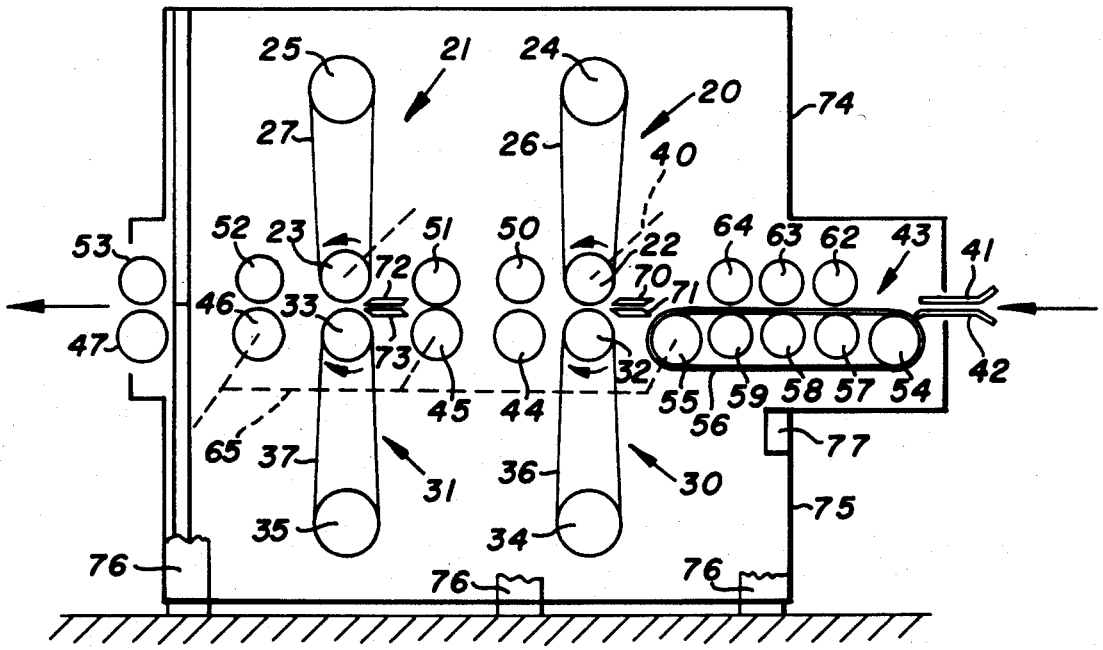
FIG. 1 is a general, somewhat schematic showing of an abrasive surfacer according to the invention.

An abrasive surfacer embodying the invention is shown somewhat schematically in FIG. 1 to comprise upper abrasive heads 20 and 21, comprising contact drums 22 and 23 and idler drums 24 and 25 around which there are trained abrasive belts 26 and 27, and lower abrasive heads 30 and 31, comprising contact drums 32 and 33 and idler drums 34 and 35 around which there are trained abrasive belts 36 and 37, all respectively. The contact drums are preferably driven by connection to individual electric motors, as suggested at 40 for drum 22.

Figure 8:
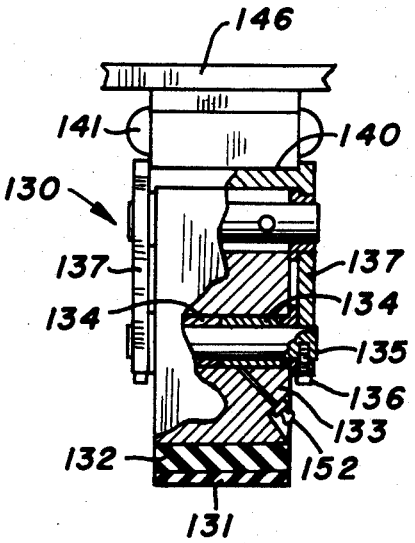
FIGS. 8 and 9 are side and end views of a pinch wheel used in the invention.
Figure 9:
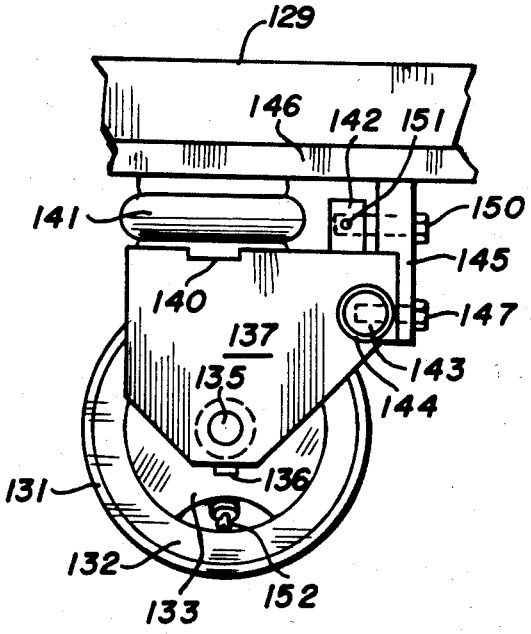

Means are provided for centering and feeding workpieces relative to a horizontal reference center plane between the abrasive heads, and include input guides 41 and 42, feedworks 43, conveyor rollers 44, 45, 46 and 47, and pinch rollers 50, 51, 52 and 53. Feedworks 43 comprises a pair of conveyor rollers 54 and 55, a conveyor belt 56, resilient idler rollers 57, 58 and 59, and hard surfaced substantially equally resilient pinch rollers 62, 63 and 64. The details of the pinch rollers are best shown in FIGS. 8 and 9. Drive means such as at 65 causes rotation of rollers 46, 45 and 55 at a common peripheral speed, and roller 55 is in driving relation to belt 56. Roller 44 may be powered from means 65 which is powered from a suitable motor, or idle, as desired.

Centering means including a pair of contact shoes 70 and 71 is associated with heads 20 and 30, and also with an upper dust collecting hood and similar centering means including a pair of contact shoes 72 and 73 associated with heads 21 and 31 and a lower dust collecting hood.

The surfacer is constructed on an upper frame 74 and a lower frame 75, and includes means 76 for adjusting the vertical relation between the frames to enable surfacing of workpieces of different thicknesses, as well as means 77 for adjusting the vertical position of feedworks members 54–59 in frame 75. Vertical adjusting means will be more fully described in connection with FIG. 2.

Abrasive belts are available in many widths, often up to and greater than five feet, and efficient use of the surfacer for workpieces of less width than the belts requires that narrower workpieces be fed through the machine in side-by-side relation by use of the present invention, as will now be described.

Figure 5:
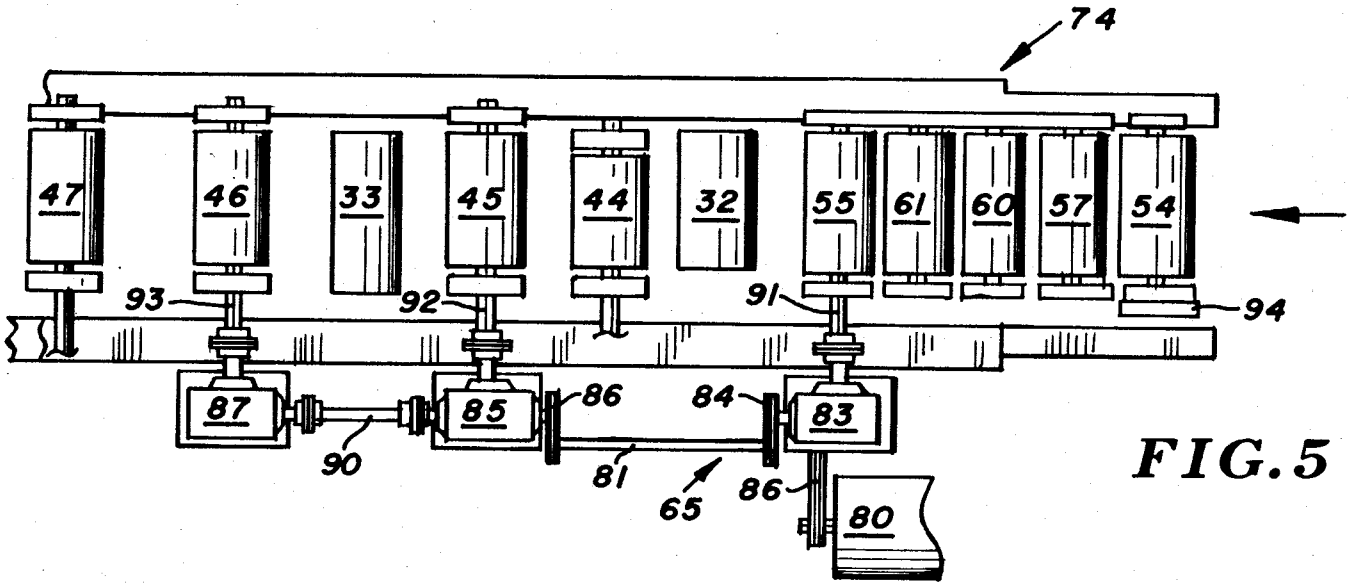
FIGS. 4 and 5 are views in rear elevation and plan of a portion of the surfacer, some parts being omitted.
Figure 4:
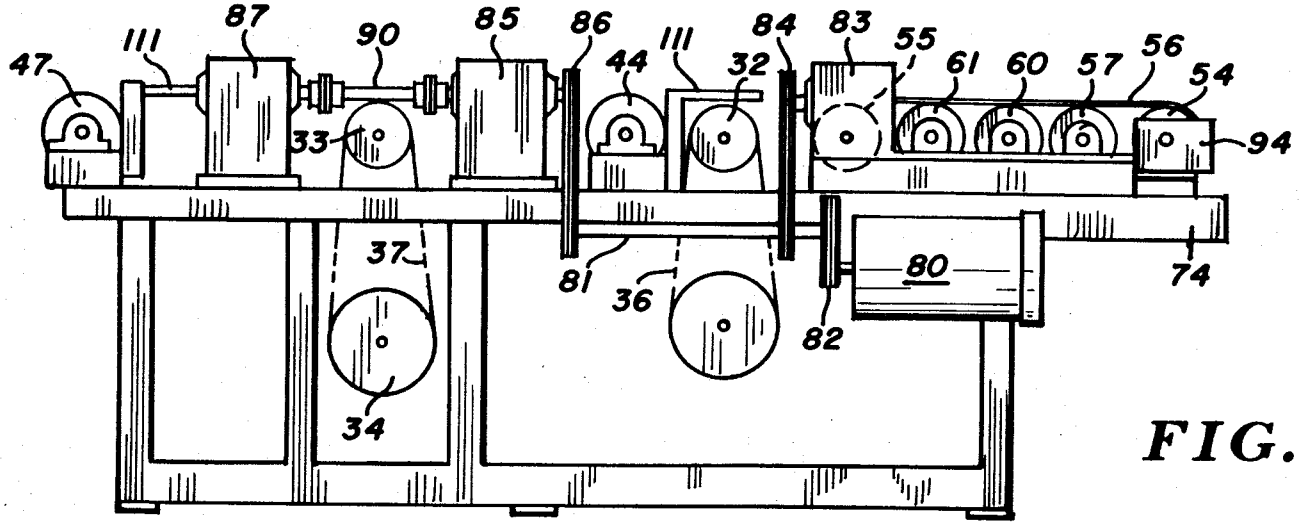

FIGS. 4 and 5 are views in elevation and plan of lower frame 74 showing drive means 65. The vertical adjusting means and centering means are omitted for clarity of illustration, and belts 36, 37, and 56 have also been omitted from FIG. 5. A motor 80 drives a jack shaft 81 through a belt 82, and jack shaft 81 drives a first gear reducer 83 through a belt 84 and a second gear reducer 85 through a belt 86. Reducer 85 is connected to drive a further gear reducer 87 through a stub shaft 90. Reducer 83 drives roller 55 through a connection 91, reducer 85 drives roller 45 through a connection 92, and reducer 87 drives roller 46 through a connection 93.

Figure 7:
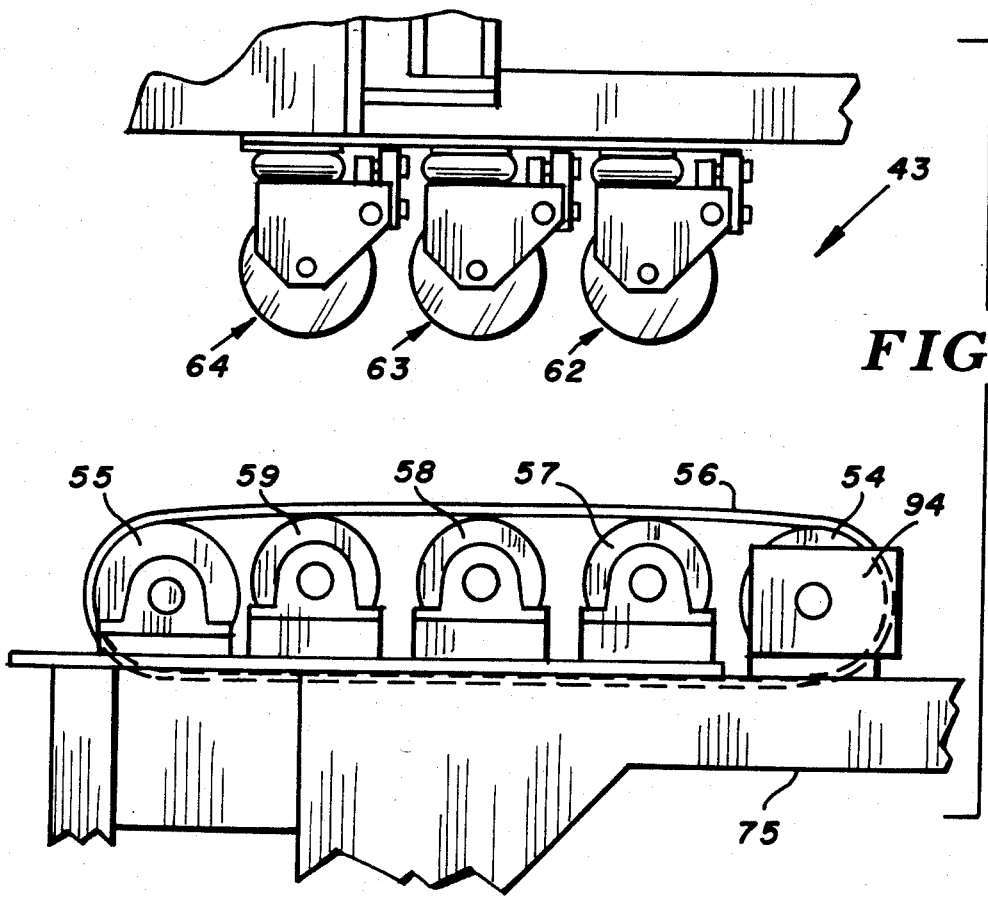
FIG. 7 is a fragmentary view in side elevation of the feedworks.

FIG. 7 shows that rollers 57, 58 and 59 of feedworks 43 are arranged to have a common upper tangent plane which is horizontal, while rollers 54 and 55 are slightly lower: conventional means 94 may be provided for tightening belt 56 by varying the position of roller 54.

Figure 2:
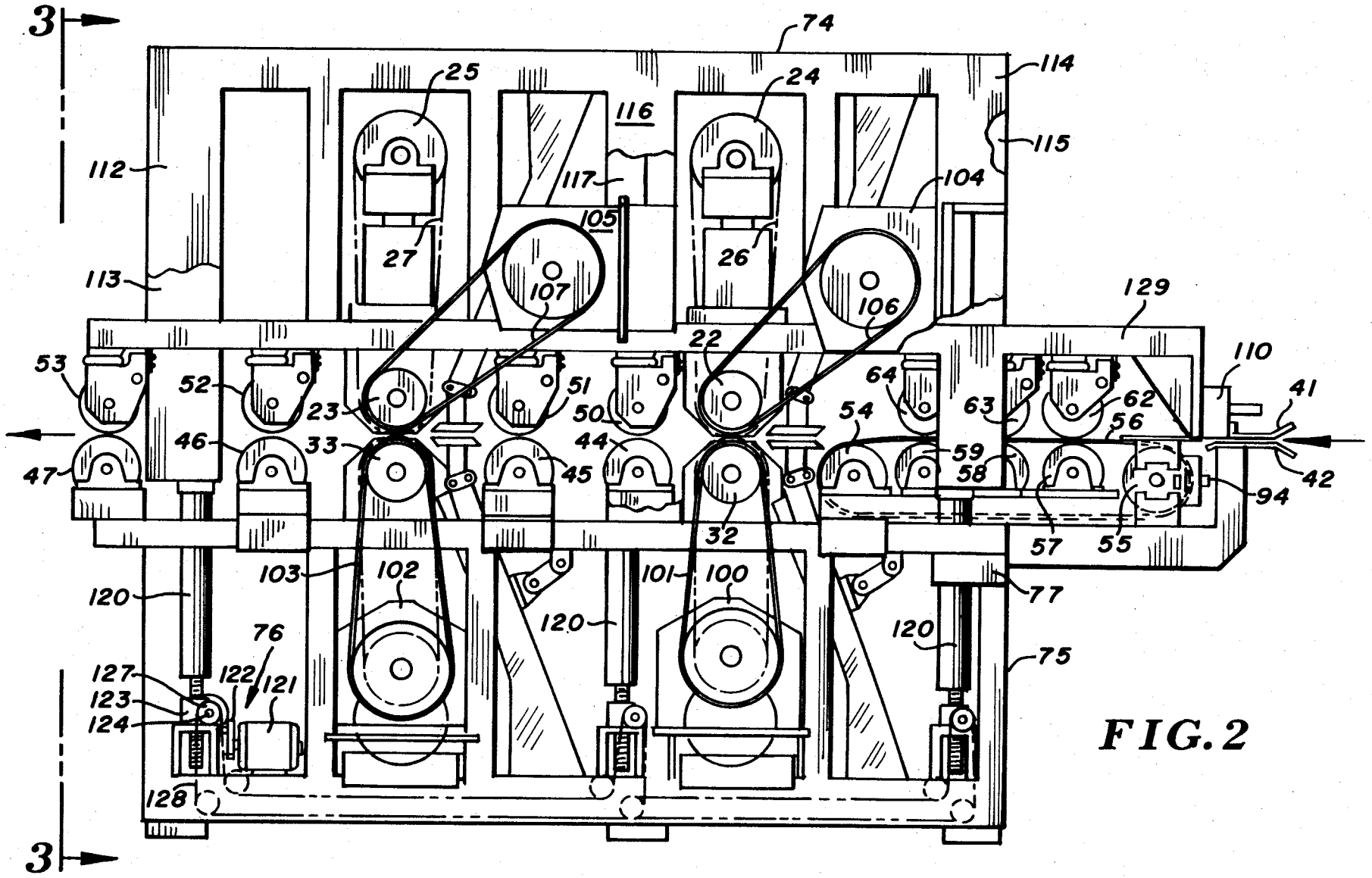
FIG. 2 is a view of the surfacer in rear elevation, with some parts omitted.
Figure 3:
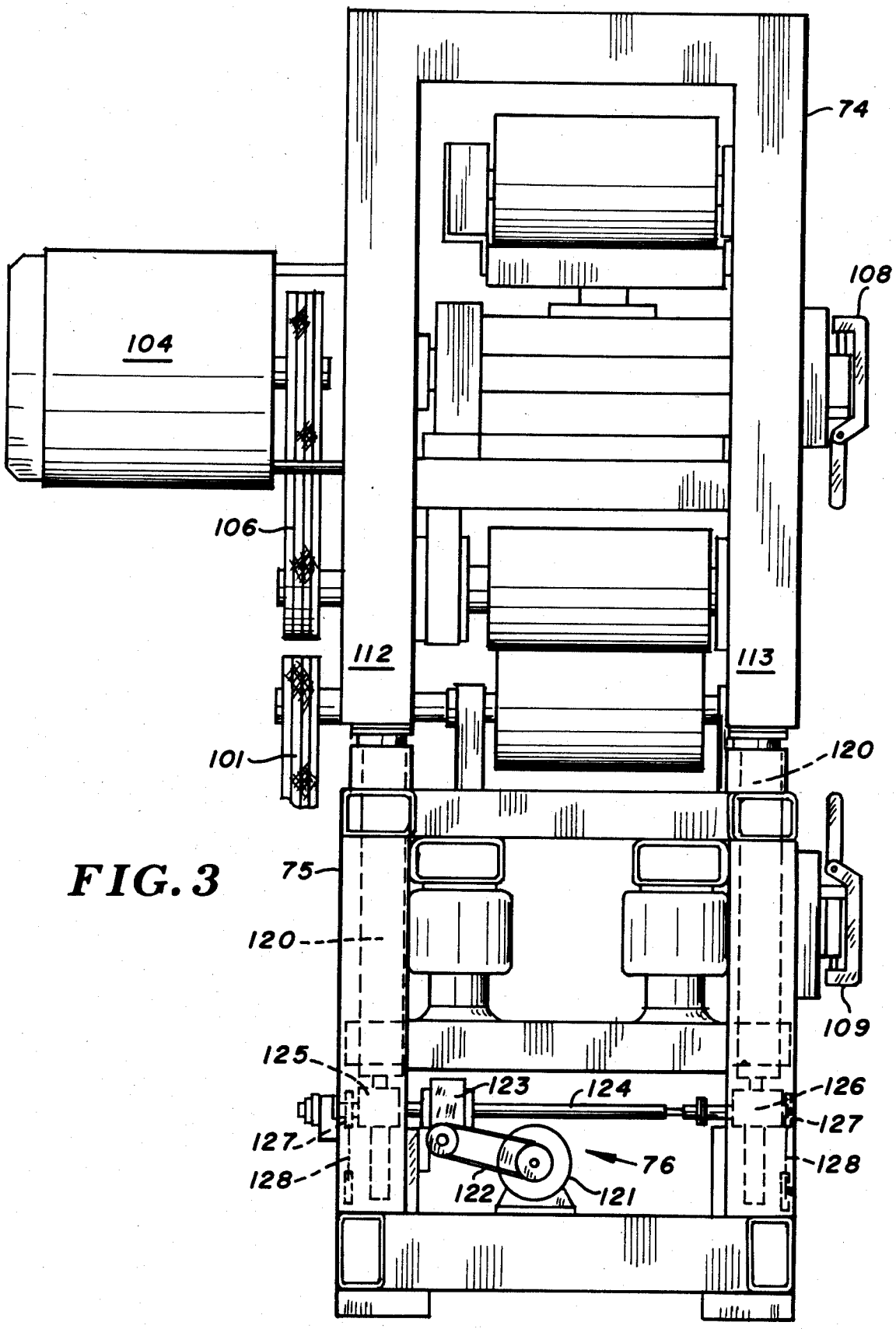
FIG. 3 is a view of the surfacer in end elevation as seen from the left in FIG. 2.

The drives for drums 32 and 33 are shown in FIG. 2, where a motor 100 drives drum 32 through a belt 101, and a motor 102 drives drum 33 through a belt 103. Motors 104 and 105 are also shown as driving drums 22 and 23 in frame 74 through belts 106 and 107. Conventional tension adjusting and centering means may be provided for the abrasive belts, and means 108 and 109 (FIG. 3) enable replacement of abrasive belts with convenience. Drive 65 is omitted from FIG. 2.

Anti-kickback means 110 may be provided at the input to the surfacer, and stock guides 111 (FIG. 4) may also be provided where desired.

Upper frame 74 (FIG. 2) has corner support posts 112, 113, 114 and 115 and intermediate support posts 116 and 117 for cooperation with thickness adjuster 76 as will now be described.

Posts 112–117 rest as their bottoms on a like number of screw jacks 120 mounted in frame 75 and driven for simultaneous operation by a motor 121 (FIG. 3) through a belt 122, a gear reducer 123, a cross shaft 124, and a pair of worm drives 125 and 126. Cross shaft 124 may be connected by a sprocket wheel 127 and chain 128 to drive similar cross shafts for the other pairs of jacks.

Upper frame 74 also includes a horizontal framework 129 for supporting rollers 50–53 and 62–64. Each of these rollers comprises a transverse row of pinch wheels 130, one of which is better shown in FIGS. 8 and 9. It will be appreciated that the lower portion of the framework includes lower support rollers 44, 45, and 46, along with conveyor supporting rolls 57, 58 and 59. Each of these rollers also comprises a transverse row of individual wheels, and are substantially identical to pinch wheels 130, hence the description of pinch wheel 103 is intended to encompass these lower rollers as well. For purposes of delivering the workpiece along a plane which centers the work between the abrasive belts, the resilient characteristics of the upper rollers will be substantially the same as the resilient characteristics of the lower rollers.

Pinch wheel 130 comprises an outer, relatively thin layer 131 of abrasion-resistant material of durometer hardness of between about 70 and 80, joined to a thicker inner layer 132 of material of a hardness of about 20, the whole being molded on a central hub 133 containing bearings 134. A shaft 135 passes through bearings 134 and is secured by fasteners 136 in a bracket 137 having an upper flat surface 140, to receive one end of an airmount 141, and an upwardly extending stop 142. Bracket 137 is bored to receive a shaft 143 on which it is free for limited pivotal movement in bearings 144 about a horizontal axis. A support stub 145 depends from a plate 146 secured to framework 129, and shaft 143 is secured to stub 145 by fasteners 147. The upper end of the airmount 141 engages plate 146, and a fastener 150 passes freely through stub 145 and is secured in stop 142 by a set screw 151 to limit the pivotal movement of the pinch wheel about shaft 143. A grease fitting 152 is preferably provided. Similar mounting arrangements are provided for the lower rollers as will be apparent from a review of this specification.

It will be appreciated that plate 146 extends transversely across framework 129 to support a plurality of laterally spaced stubs and pinch wheels making up each pinch roller. In one embodiment of the invention each roller comprises eight pinch wheels, each about 10 inches in diameter and 4½ inches wide.

Figure 6:
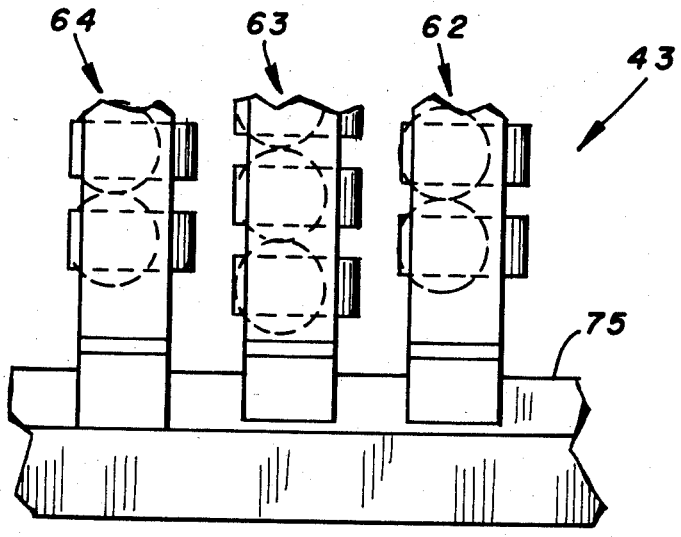
FIG. 6 is a fragmentary top view of a portion of a feedworks used in the invention.

FIG. 6 shows that in feedworks 43 the pinch wheels of rollers 62, 63 and 64 are preferably offset or staggered rather than aligned longitudinally of the surfacer, to give more satisfactory operation and avoid "roller splits".

Rollers 44–47, 54, 55, 57, 58, and 59 may also be composed of a plurality of narrow rolls if desired, but single rollers continuous over the width of the surfacer are ordinarily acceptable since ordinarily only a relatively light cut is taken from the bottom of the workpieces. These rollers also are preferably constructed with a thin, outer, harder layer and a thicker, inner, softer layer.

Attention is now directed to FIGS. 10 and 11, which show the mechanism associated with lower shoe 71 and suggested schematically in FIG. 2, with an identical mechanism being associated with the second lower shoe 73. A dust collecting shroud 153 is associated with idler drum 34, and is connected by a duct 154 to a dust extracting system not shown. A second dust collecting shroud 155 associated with contact drum 32 is connected to the extraction system via duct 156, and is mounted to frame 75 by a parallel linkage made up of four links of equal length.

A first pair of links 157 and 160 are pivoted at first ends on fasteners 161 and 162 in a pair of brackets 163 and 164 mounted on the frame. The other ends of the links are pivoted on fasteners 164 and 166 in a pair of brackets 167 and 170 mounted on shroud 155.

Figure 14:
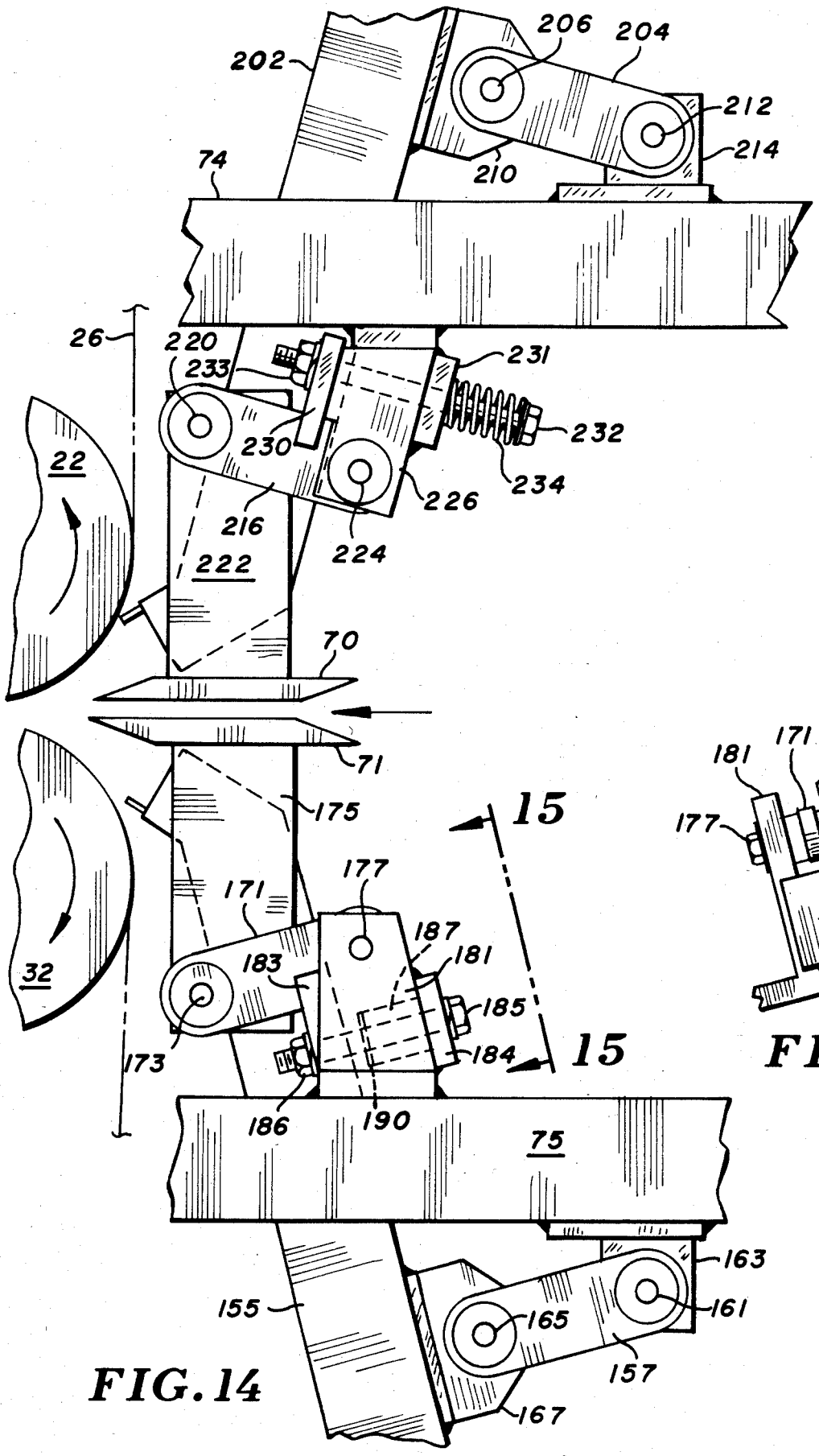
FIG. 14 is a detailed view to a larger scale of the upper and lower centering mechanisms.
Figure 15:
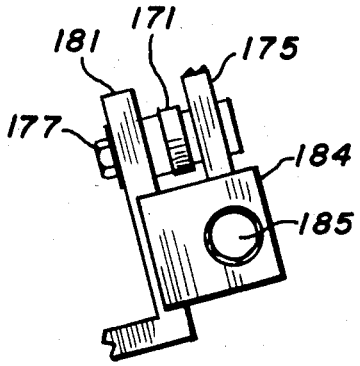
FIG. 15 is a fragmentary view in the direction indicated by the line 15—15 in FIG. 14.

A second pair of links 171 and 172 are pivoted at first ends on pins 173 and 174 extending from plates 175 and 176 secured to the side edges of shroud 155. The other ends of links 171 and 172 are pivoted on fasteners 177 and 180 in brackets 181 and 182 secured to frame 75. As shown more clearly in FIG. 14, link 171 has a lug 183 projecting generally downwardly, and bracket 181 has a lug 184, projecting generally inwardly. A fastener 185 passes freely through an aperture in lug 184 and is secured in lug 183 by means including a lock nut 186. One end of a compression spring 187 bears against lug 184, and the other end of the spring bears against a washer 190 fixed to fastener 185, so that as link 171 pivots in a counter-clockwise direction on fastener 177, spring 187 is compressed. Like structure is provided for link 172, and anti-friction bearings can be supplied for the pivot fasteners of links 157, 160, 171, and 172 if desired.

Shoe 71 is carried on plates 175 and 176 and a mounting rail 191 extending between them. If desired, shoe 71 may be made up of a number of independent segments 192, 193, 194 and 195 either rigidly or resiliently mounted in end-to-end relationship in rail 191, the joints extending along the direction of movement of the workpieces, as shown in FIG. 11.

Figure 13:
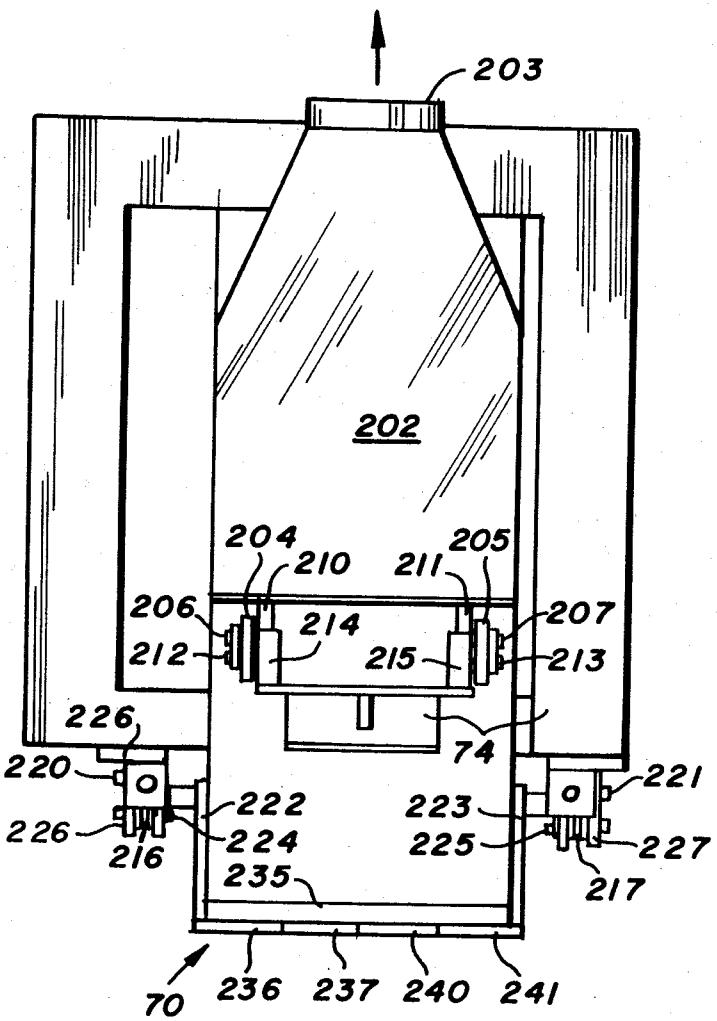
FIG. 13 is a side view of the structure of FIG. 12.
Figure 12:
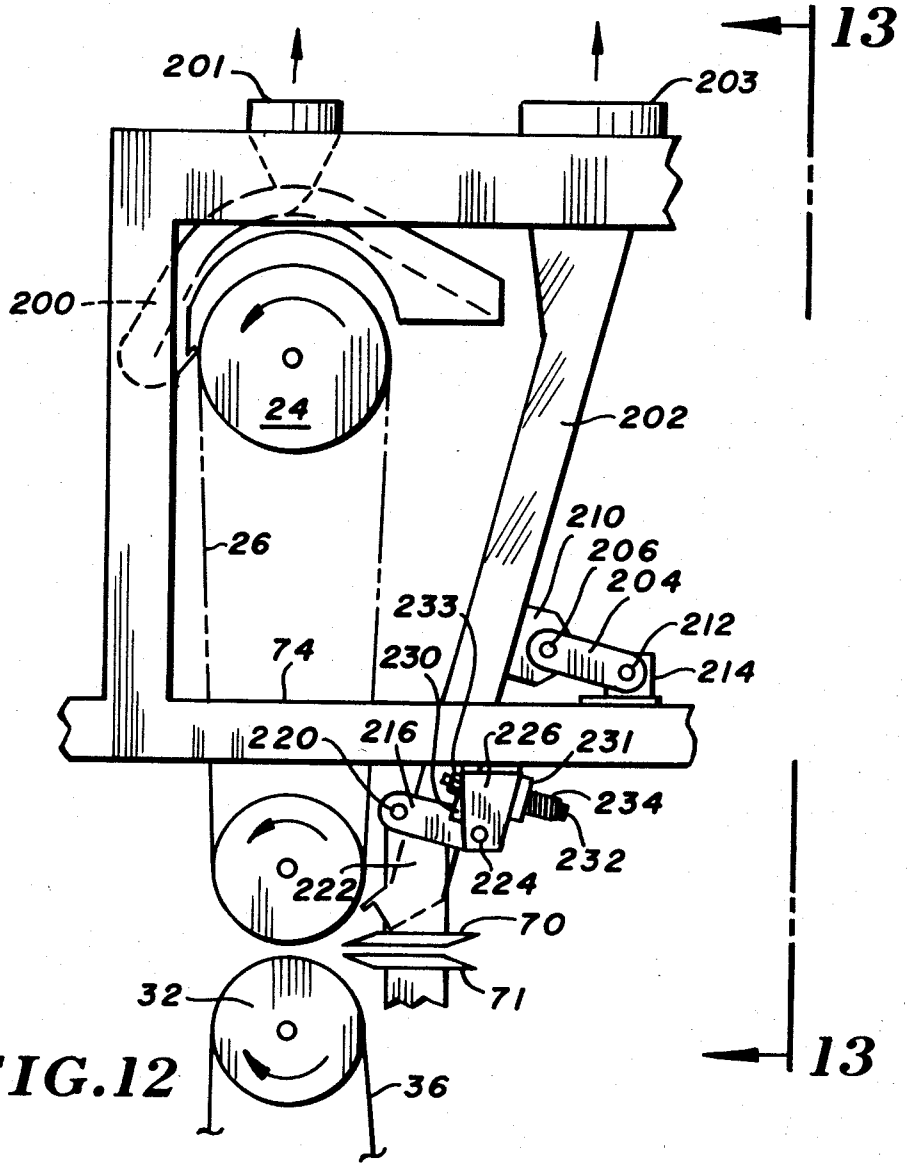
FIG. 12 is a view like FIG. 10 of an upper dust collector and centering mechanism.

Attention is now directed to FIGS. 12 and 13, which show the mechanism associated with upper shoe 70 and suggested schematically in FIG. 2, with an identical mechanism being associated with shoe 72. A dust collecting shroud 200 is associated with idler drum 24, and is connected via duct 201 with the dust extraction system. A second dust collecting shroud 202 is connected to the extraction system by a duct 203, and is mounted to frame 74 by a parallel linkage made up of four links of equal length.

A first pair of links 204 and 205 are pivoted at first ends on fasteners 206 and 207 to a pair of brackets 210 and 211 mounted on shroud 202. The other ends of the links are pivoted in fasteners 212 and 213 in a pair of brackets 214 and 215 carried by frame 74.

A second pair of links 216 and 217 are pivoted at first ends on pins 220 and 221 extending from plates 222 and 223 carried on the side edges of shroud 202. At their other ends links 216 and 217 are pivoted on fasteners 224 and 225 in brackets 226 and 227 secured to frame 74. As is shown more clearly in FIG. 14, link 216 has a lug 230 extending generally upwardly, and bracket 226 has a lug 231 extending generally inwardly. A fastener 232 passing freely through lug 231 is secured to lug 230 by means including a lock nut 233. One end of a compression spring 234 bears against lug 231, and the other end bears against the head of fastener 232, so that as link 216 pivots in a clockwise direction at fastener 224, spring 234 is compressed. Like structure is provided for link 217, and anti-friction bearings can be supplied for the pivot fasteners of links 204, 205, 216 and 217 if desired.

Shoe 70 is carried on plates 222 and 223 and a mounting rail 235 extending between them. If desired, shoe 70 may be made up of a number of segments 236, 237, 240, and 241 resiliently mounted in rail 235, as described for shoe 71 above. The resilient mounting for the upper and lower dust collecting shrouds are arranged to provide a substantially equal mechanical bias so that the individual shrouds may move apart equidistantly while preserving the centered relationship of the work with respect to the individual pairs of opposed abrasive belts.

OPERATION

The operation of the invention will now be apparent. Motor 121 is operated to set the vertical distance between frames 74 and 75 so that drums 22 and 32 and drums 23 and 33 are spaced to give the desired thickness of workpieces passing from the machine. Feedworks 43 is adjusted vertically in frame 75 to cause a desired thickness of material to be removed from the under faces of the workpieces, the remainder being removed from the upper surfaces. It will be clear that as upper frame 74 moves vertically, the spacings between upper shoes 70 and 72 and lower shoes 71 and 73 also vary, and also that suitable variation will occur in the spacing between conveyor rolls 44–47 and pinch rolls 50–53, as well as between belt 56 and pinch rolls 62–64. The dust extraction system is put into operation, the drive motors for the abrasive belts are energized, and when feed mechanism 65 is energized, the machine is ready for operation.

Workpieces are fed through input guides 41 and 42 until they are gripped between belt 56 and pinch rolls 62, 63, 64, and the pieces advance so that their leading edges contact shoes 70 and 71. The shoes are shaped to be spread by this contact, upper shoe 70 being kept parallel to itself by the linkage including links 204 and 216, and lower shoe 71 being kept parallel to itself by the linkage including links 157 and 171.

Ordinarily the resilience of the inner portions of the pinch wheels and conveyor rollers is sufficient to accommodate variations in the thickness of workpieces passing through the surfacer. If a workpiece of unusual thickness or warpage is encountered, the airmounts come into function to accommodate this anomalous condition.

Any workpiece long enough to be at all times engaged by the feedworks or at least one conveyor roll is fed through the machine and discharged from rollers 47 and 53 surfaced and transvesely flat on both faces, and of a desired thickness. When a workpiece leaves shoes 70, 71, spring 187 raises the latter to its former position, while shoe 71 returns under gravity, spring 233 having served simply to control the upward movement of shoe 70 when the workpiece engages it. Thus, shoes 70 and 71, which are disposed intermediate the abrasive belts 26 and 36 and the feedworks 43 function to position work centrally of the abrasive belts 26 and 36, with guide shoes 70 and 71 being substantially equally mechanically biased toward each other.

If the workpieces are in side-by-side relation and are not flat, or are of somewhat different thicknesses, the pinch wheels can displace sufficiently so that adequate drive contact with all the workpieces is maintained.

From the above it will be evident that the invention comprises feed means including resiliently mounted pinch wheels of special construction, and centering means, including movably mounted contact shoes, by the use of which plural workpieces narrower than the width of the abrasive belt may safely and efficiently be surfaced simultaneously.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. A driven feed assembly for an abrasive surfacer having at least one pair of vertically spaced apart upper and lower abrasive heads, the feed assembly comprising:

(a) feedworks means including opposed upper and lower conveying assemblies each mounted to a frame and relative to a reference center plane between said upper and lower abrasive heads for substantially centering the upper and lower surfaces of workpieces relative to the center plane and for conveying the workpieces longitudinally past said upper and lower abrasive heads so as to cause each workpiece to simultaneously and substantially equally engage the upper and lower abrasive heads as they are conveyed thereby;

(b) said upper conveying assembly comprising a plurality of resilient and passive upper pinch rollers, each pinch roller comprising a generally transverse row of upper pinch wheels mounted to contacting workpieces passing thereunder, wherein each of said pinch wheels includes inner and outer annular layers of different hardness, each inner annular layer comprising a relatively soft and resilient material, each outer annular layer comprising a relatively harder material said wheels independently contacting and, by elastic deformation of their respective inner and outer layers, applying a corrective downward force to the opposed upper surface portion of the workpieces along contact lines as the workpieces pass thereunder;

(c) said lower conveying assembly comprising an endless driven conveyor belt having a pluraity of passive and resilient idler rollers mounted between an associated drive conveyor roller and an idler conveyor roller and contacting the inside upper surface of said conveyor belt in opposed relationship to said upper pinch rollers and substantially parallel to the contact lines of said upper pinch rollers, whereby said idler rollers, acting through said conveyor belt, apply corrective upward forces to the workpieces as they are conveyed thereover by said conveyor belt; and (d) a pneumatic spring means for independently biasing each of said upper pinch wheels downward against its associated one of said workpieces, and for permitting upward movement of said upper pinch wheels in response to a portion of unusual thickness of warpage in said workpiece.

2. The driven feed assembly of claim 1 wherein: the radial dimension of each said inner annular layer is greater than the radial dimension of its associated outer annular layer.

3. The driven feed assembly of claim 2 wherein: each of said inner annular layers comprises a material of approximately 20 durometer, and each of said outer annular layers comprises a material of a durometer of between about 70 and 80.

4. The driven feed assembly of claim 2 wherein: each of said passive and resilient idler rollers of said lower conveying assembly comprises a generally transverse row of lower pinch wheels, each lower pinch wheel including inner and outer annular layers of different hardness, each inner annular layer comprising a relatively soft and resilient material, and each outer annular layer comprising a relatively harder material.

5. The driven feed assembly of claim 4 including a lower pneumatic spring means for independently biasing each of said lower pinch wheels upward against said conveyor belt as the conveyor belt carries an associated one of said workpieces thereover, ad for permitting downward movement of said lower pinch wheel in response to a portion of unusual thickness or warpage in said workpiece.

6. The driven feed assembly of claim 1 wherein: the upper pinch wheels in each pinch roller are transversely spaced apart from one another, and transversely offset from the pinch wheels in each adjacent pinch roller.

7. The driven feed assembly of claim 1 wherein: said pneumatic spring means includes an air mount associated with each upper pinch wheel, and wherein a support means for supporting each of said upper pinch wheels relative to said frame comprises:

(a) a first mounting member fixedly mounted to said frame;

(b) first and second side plates transversely spaced apart from one another via an intermediate orthogonal second mounting member;

(c) a first axle passing through said first and second side plates and means clamping said first axle between said side plates such that said side plates may rotate about said first axle;

(d) a second axle contained between said first and second side plates for mounting one of said upper pinch wheels rotatably relative to said first and second side plates; and (e) one of said air mounts positioned between said frame and said first and second side plates and overlying said upper pinch wheel, whereby said pinch wheel may resiliently rise and fall while said air mount applies a corrective vertical force whenever said upper pinch wheel encounters unusual warpage of the like in the workpieces.

8. The driven feed assembly of claim 1 further including:

(a) a first and second pair of links, each link pivotally mounted at one end with respect to said frame and at the other end with respect to an upper shroud located above said center plane, and an upper contact shoe mounted to said upper shroud downstream from said feedworks means and proximate said center plane;

(b) a third and fourth pair of links, each link pivotally mounted at one end with respect to said frame and at the other end with respect to a lower shroud located below said center plane, and a lower contact shoe mounted to said lower shroud in opposed relation to said upper contact shoe;

(c) an upper biasing means for urging said upper shroud and contact shoe downwardly toward said center plane, and a lower biasing means for biasing said lower shroud and contact shoe upwardly toward said center plane;

(d) said first and second pairs of links being substantially equal in length, and said third and fourth pairs of links being substantially equal in length;

(e) said upper and lower biasing means providing substantially equal mechanical bias to said upper and lower contact shoes, respectively, whereby said shoes, when moved apart by workpieces against the force of their respective biasing means, tend to center the workpieces on said center plane.

* * * * *

UNITED STATES PATENT AND TRADEMARK OFFICE

CERTIFICATE OF CORRECTION

PATENT NO. : 4,594,815

DATED : June 17, 1986

INVENTOR(S) : Maurice G. Mickelson et al

It is certified that error appears in the above-identified patent and that said Letters Patent are hereby corrected as shown below:

Column 6, Line 66, "to" should read -- for --.

Column 7, Line 12, "pluraity" should read -- plurality --.

Column 7, Line 52, "ad" should read -- and --.

Signed and Sealed this

Fourteenth Day of October, 1986

[SEAL]

*Attest:*

DONALD J. QUIGG

*Attesting Officer*

*Commissioner of Patents and Trademarks*